US009138112B2

(12) United States Patent
Ferro

(10) Patent No.: US 9,138,112 B2
(45) Date of Patent: Sep. 22, 2015

(54) TOILET COVER HAVING INTERNAL CLEANING MECHANISM

(71) Applicant: Michael Ferro, Bronxville, NY (US)

(72) Inventor: Michael Ferro, Bronxville, NY (US)

( * ) Notice: Subject to any disclaimer, the term of this patent is extended or adjusted under 35 U.S.C. 154(b) by 181 days.

(21) Appl. No.: 13/648,488

(22) Filed: Oct. 10, 2012

(65) Prior Publication Data

US 2014/0096314 A1 Apr. 10, 2014

(51) Int. Cl.
*A47K 13/00* (2006.01)
*A47K 13/30* (2006.01)

(52) U.S. Cl.
CPC ..... *A47K 13/302* (2013.01)

(58) Field of Classification Search
CPC ..... A47K 13/302
USPC ..... 4/233
See application file for complete search history.

(56) References Cited

U.S. PATENT DOCUMENTS 2,104,947 A * 1/1938 Joosten ..... 4/234
4,873,729 A * 10/1989 Micallef ..... 4/233
7,117,549 B1 * 10/2006 Hannigan ..... 4/233

* cited by examiner

*Primary Examiner* — Janie Christiansen
(74) *Attorney, Agent, or Firm* — Leason Ellis LLP

(57) ABSTRACT

A toilet seat assembly has a user operated cleaning feature in the form of a mechanism that includes a plurality of discharge ports formed within a toilet seat cover and being open along the bottom surface of the toilet seat cover. The mechanism also includes a manually operated actuator that is accessible along one surface of the toilet seat cover and a reservoir for containing a sanitizing agent. The actuator is operably coupled to the reservoir and operable to drive the sanitizing agent from the reservoir and out of the discharge ports so as to allow sanitizing agent to be delivered to the top surface of the toilet seat when the actuator is operated with the seat cover in the closed position.

15 Claims, 3 Drawing Sheets

TOILET COVER HAVING INTERNAL CLEANING MECHANISM

TECHNICAL FIELD

The present invention is generally directed to toilet seat assemblies and more particularly, to a toilet cover for use in a toilet seat assembly and being configured to have a user activated toilet seat cleaning mechanism for applying a sanitizing agent (disinfectant) to the toilet seat.

BACKGROUND

As is known, a bathroom of a house is an area that is particularly suited for the growth of bacteria, mold, etc., due to its warm, moist environment as well as the human activities that take place in the bathroom. A toilet is one structure in the bathroom in which bacteria can grow if the surfaces are not kept clean. In addition, since a user places bare skin against the toilet seat, there is an increased desire for the toilet seat to be clean.

There are several different types of self-cleaning, disinfecting systems that are incorporated into the design of the toilet. However, many of these designs are very complicated and typically are incorporated into the toilet seat itself. In particular, in a number of these self-cleaning systems, the cleaning mechanism is directly tied to the flush mechanism and this makes the system overly complex and also, requires that the cleaning action occur with a flushing action. Thus, the user cannot clean the toil seat without flushing the toilet. This can lead to unnecessary water consumption. In addition, other designs incorporate electric motors as part of the self-cleaning system and this complicates the design and requires costly modification of bathrooms.

There is therefore a need for a simple, yet effective mechanism for cleaning a toilet seat cover and seat that overcomes the disadvantages of the prior art.

SUMMARY

In one embodiment, a toilet seat assembly that has a user operated cleaning feature includes a toilet seat defined by a body having a central opening formed therein and a toilet seat cover that is pivotally attached to the toilet seat and movable between open and closed positions. The toilet seat cover has a bottom surface that faces the toilet seat in the closed position and an opposing top surface. The assembly also includes a cleaning mechanism that is disposed within the toilet seat cover. The mechanism includes a plurality of discharge ports formed within the toilet seat cover and being open along the bottom surface of the toilet seat cover. The mechanism also includes a manually operated actuator that is accessible along one surface of the toilet seat cover and a reservoir for containing a sanitizing agent. The actuator is operably coupled to the reservoir and operable to drive the sanitizing agent from the reservoir and out of the discharge ports so as to allow sanitizing agent to be delivered to the top surface of the toilet seat when the actuator is operated with the seat cover in the closed position.

In another embodiment, a toilet seat assembly has a user operated cleaning feature. The assembly includes a toilet seat defined by a body having a central opening formed therein. The assembly includes a toilet seat cover that is pivotally attached to the toilet seat and movable between open and closed positions. The toilet seat cover has a bottom surface that faces the toilet seat in the closed position and an opposing top surface. The assembly also includes a manually operated cleaning mechanism that is disposed within the toilet seat cover. The mechanism includes a plurality of discharge ports formed within the toilet seat cover and being open along the bottom surface of the toilet seat cover. When the toilet seat cover is in the closed position, the discharge ports overlie the toilet seat. The mechanism includes a manually operated actuator that is formed of a compressible member and is accessible along the top surface of the toilet seat cover. The actuator is configured to generate compressed air.

The mechanism further includes a reservoir for containing a sanitizing agent. The actuator is in fluid communication with the reservoir so as to permit compressed air generated by the actuator to be delivered to the reservoir, thereby causing displacement of an amount of the sanitizing agent out of the reservoir. The displaced sanitizing agent flows to and out of the discharge ports so as to allow sanitizing agent to be delivered to the top surface of the toilet seat when the actuator is operated with the seat cover in the closed position.

BRIEF DESCRIPTION OF THE DRAWING FIGURES

Figure 5A:
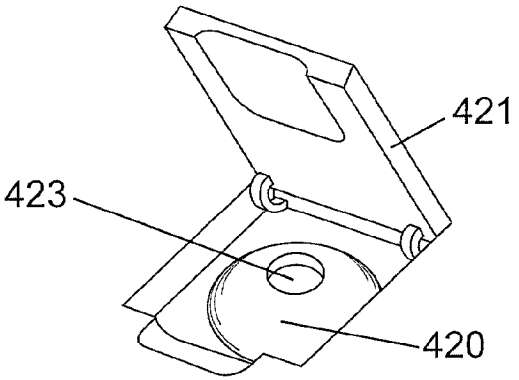
Figure 5B:
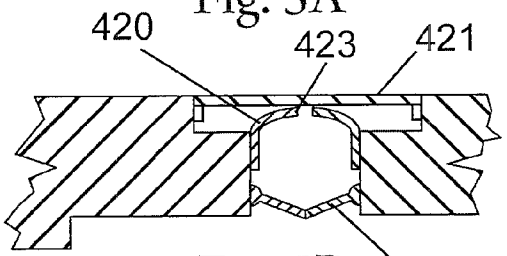
Figure 5C:
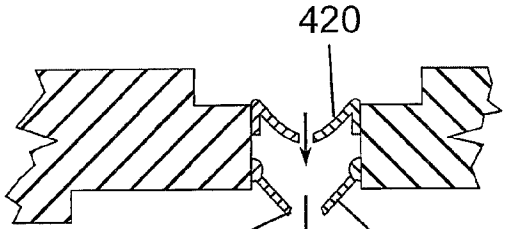
Figure 6A:
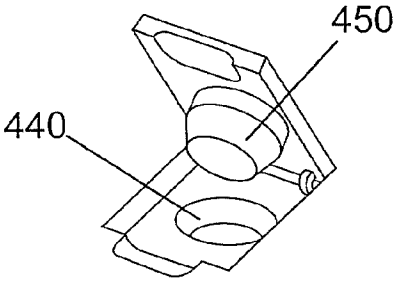
Figure 6B:
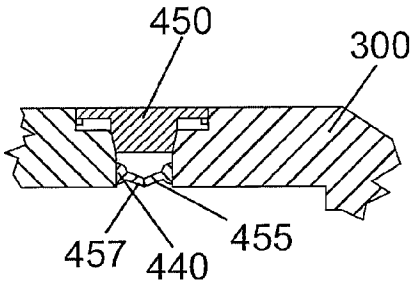

FIG. 5*a* is a perspective view of an actuator that is part of a self-cleaning (sanitizing) mechanism in accordance with the present invention;

FIG. 5*b* is a cross-sectional view of the actuator of FIG. 5*a* in a closed, rest position;

FIG. 5*c* is a cross-sectional view of a valve associated with the actuator, wherein the valve is shown open and the actuator is shown in an activated state;

FIG. 6*a* is a perspective view of a fill port with a movable plug in a closed position; and FIG. 6*b* is a cross-sectional view of the plug in the closed (sealed) position.

DETAILED DESCRIPTION OF CERTAIN EMBODIMENTS

Figure 1:
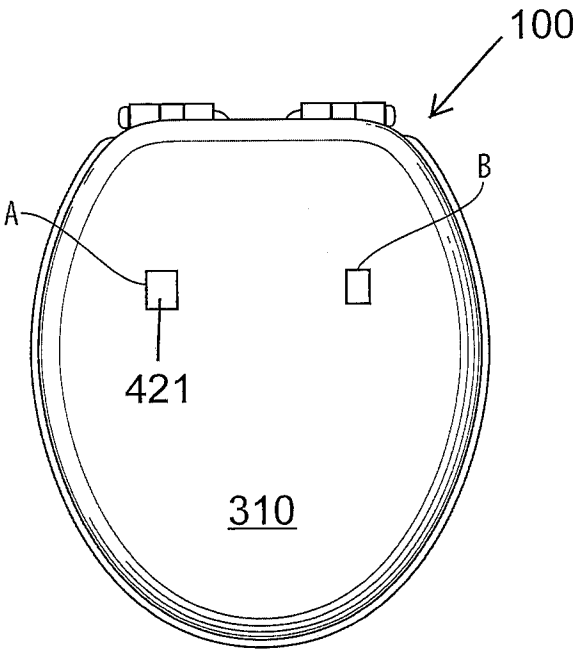
FIG. 1 is a top plan view of a toilet seat assembly showing a toilet seat cover in accordance with the present invention and showing the toilet seat cover in a closed position.

FIGS. 1-6*b* show a self-cleaning toilet seat assembly 100 for use with a traditional residential toilet (not shown). As is know, a traditional toilet seat assembly is made up of two primary components, namely, a toilet seat on which the user sits and a toilet seat cover that selectively covers the toilet seat. The assembly is mounted to the toilet using conventional fasteners and mounting structures. The toilet seat assembly 100 of the present invention includes these two primary components in that the assembly 100 includes a toilet seat 200 and a toilet seat cover 300 which is pivotally mounted to the toilet seat 200 and moves between an open position (FIG. 2) and a closed position (FIG. 1).

In accordance with the present invention, the toilet seat 200 can be of a conventional design in that it is a continuous looped structure that has a center opening 210 formed therein. The toilet seat 200 has a generally oval shape. The toilet seat 200 can be formed from any number of different materials. The toilet seat 200 has an upper surface 210 and an opposite lower surface 220, with the lower surface 220 facing and being in contact with the bowl of the toilet. The entire assembly 100 is mounted to the bowl using conventional fasteners (e.g., mounting bolts and nuts).

The toilet seat cover 300 is pivotally attached to the toilet seat 200 and more specifically, the toilet seat cover 300 is pivotally attached to the toilet seat 200 by a hinge 250. The hunger 250 permits the toilet seat cover 300 to pivot and move between the open and closed positions. The toilet seat cover 300 is a solid structure that has a shape and dimensions to completely cover the center opening 210. The toilet seat 300 is thus configured to rest on the toilet seat 200. The toilet seat cover 300 has a top surface 310 and an opposing bottom surface 312, with the bottom surface 312 facing the toilet seat 200 when the toilet seat cover 300 is in the closed position and rests upon the toilet seat 200.

In accordance with the present invention and as best shown in FIGS. 1-4, the toilet seat cover 300 is constructed such that it includes a user activated sanitizing mechanism 400. The user activated sanitizing (cleaning) mechanism 400 is designed such that is entirely contained within the toilet seat cover 300 unlike other conventional mechanisms. In addition, in contrast to other complex systems of the prior art, the assembly 100 of the present invention does not, in one embodiment, contain electronic components, such as motors, and is not operatively connected via a linkage to the toilet flush mechanism.

Figure 2:
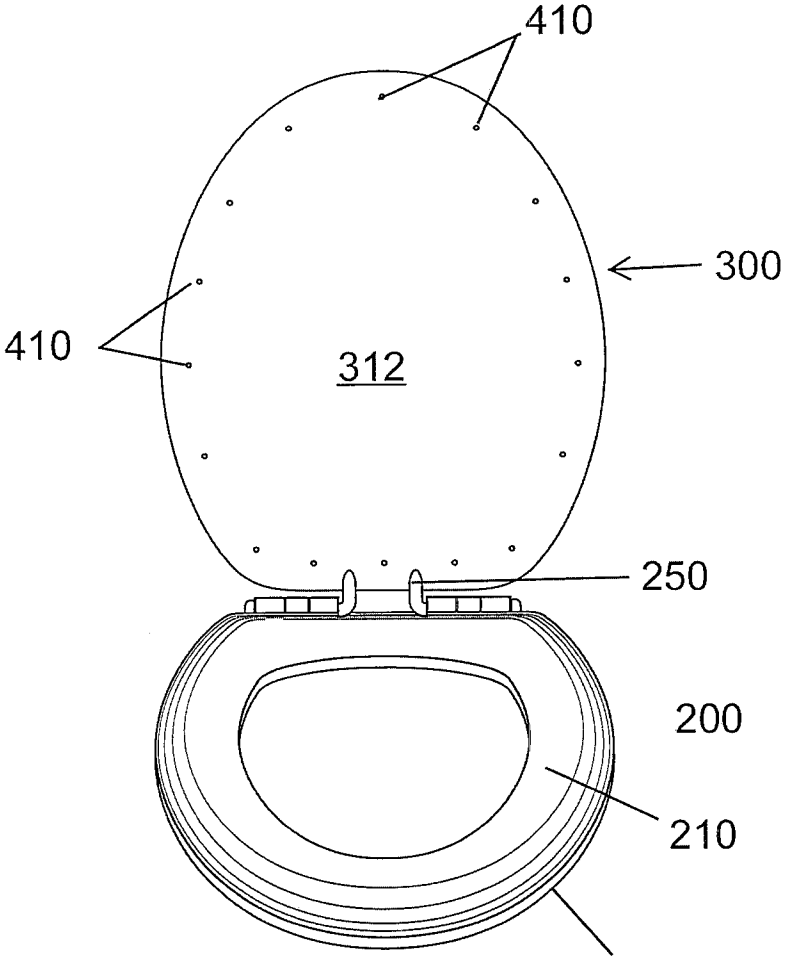
FIG. 2 is front perspective view of the toilet seat assembly with the toilet seat cover in a raised position.

The sanitizing mechanism 400 includes a number of discharge (exit) ports 410 formed along the bottom surface 312 of the toilet seat cover 300. As shown in FIG. 2, the discharge ports 410 are formed in select locations around the periphery of the toilet seat cover 300. For example, the discharge ports 410 can be generally formed in a circular pattern around the toilet seat cover 300. The discharge ports 410 are thus open along the bottom surface 312.

The number of discharge ports 410 shown in FIG. 2 is merely exemplary in nature and not limiting of the present invention. There should be enough discharge ports 410 such that when the mechanism 400 is actuated, there is sufficient discharge of the sanitizing agent (e.g., disinfectant liquid, gel, foam, etc.) over the toilet seat 200.

The size and shape of the discharge ports 410 can vary depending upon the particular application. For example, each discharge port 410 can have a small circular shape to discharge a desired amount of the sanitizing agent. In one embodiment, the discharge ports 410 can resemble pin hole like through holes through which the sanitizing agent is discharged. As will be appreciated below, the size of the discharge ports 410 are selected such that the sanitizing agent does not freely run out of the ports 410 due to fluid dynamics, including surface tension considerations, size of the discharge port, etc. Instead, an applied force is needed in order to cause the sanitizing agent to flow through and be discharged through the ports 410 as described below.

Figure 3:
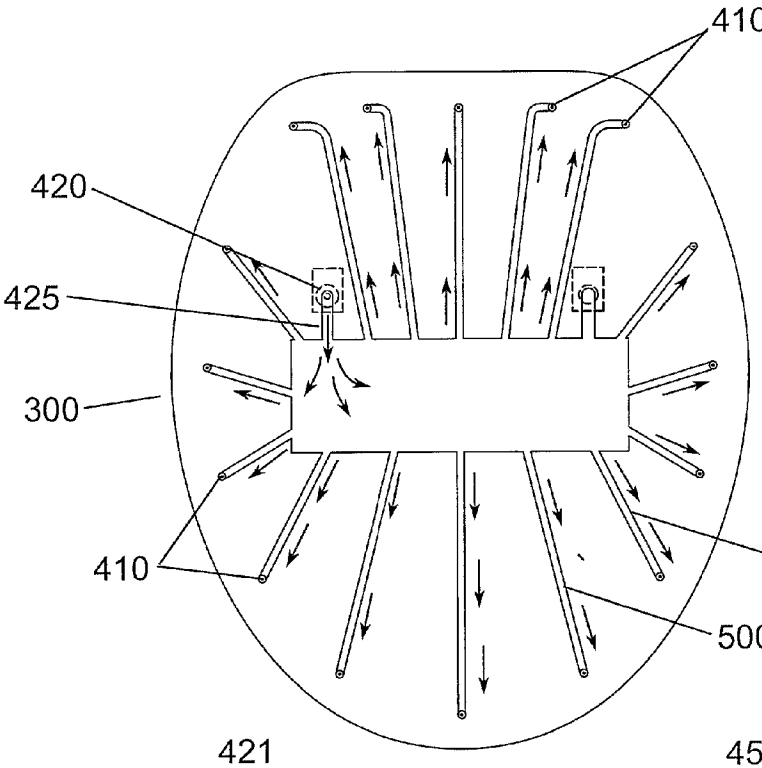
FIG. 3 is a cross-sectional view of the toilet seat cover.
Figure 4:
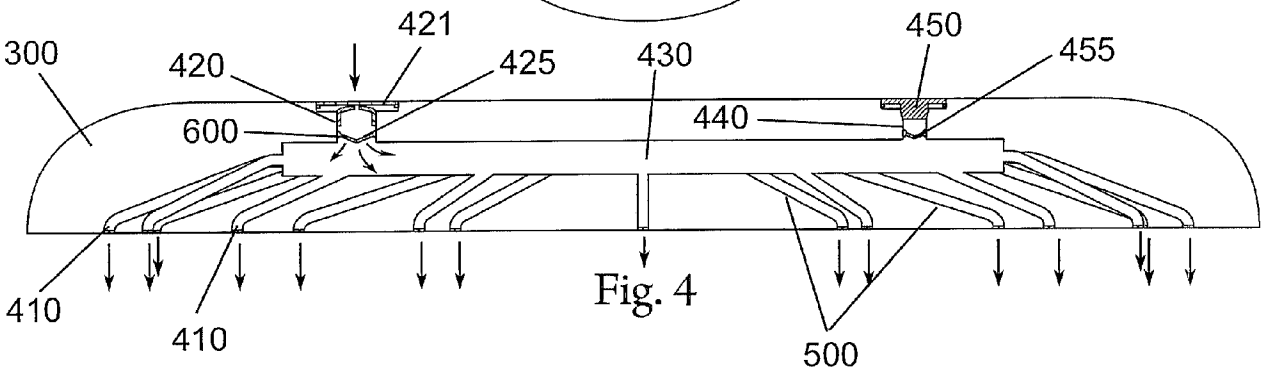
FIG. 4 is an additional cross-sectional view of the toilet seat cover.

As shown in FIGS. 3-4, most the mechanism 400 is contained internally within the seat cover 300. As shown in FIG. 1, the mechanism 400 includes an actuator 420 that is accessible to the user and is preferably, a manual type actuator as opposed to an electronic type. The actuator 420 is designed such that when the user desires for the sanitizing agent to be discharged through the ports 410 for cleaning of the underneath toilet seat 200, the user activates the actuator 420. In the illustrated embodiment, the actuator 420 is a depressable button; however, it will be appreciated that any number of different actuators can be used so long as the actuator performs the intended function as described herein.

The actuator 420 is thus accessible to the user and in the illustrated embodiment, the actuator 420 is accessible along the top surface 310 of the toilet seat cover 300. As shown in FIG. 4, the actuator 420 can be covered by a lid or cover 421. The lid 421 serves to protect the actuator 420 and can easily be opened to allow the user immediate access to the actuator 420; however, it will be appreciated that the lid 421 can be eliminated and instead, the user can have direct access to the actuator 420. When closed, the lid 421 can be flush with the surrounding top surface 310.

The mechanism 400 also includes a reservoir or well 430 that stores the sanitizing agent. The reservoir 430 is thus formed integrally within the toilet seat cover 300 and as shown in FIGS. 3 and 4 can represent a hollow space within the seat cover 300. The size and shape of the reservoir 430 can vary and are not limiting of the scope of the present invention. The actuator 420 is in fluid communication with the reservoir 430 since the actuator 420 is responsible for causing movement and discharge of the stored sanitizing agent. The discharge ports 410 are in fluid communication with the reservoir 430 and therefore, the sanitizing agent can be delivered from the reservoir 430 to the discharge ports 410.

The mechanism 400 also includes a means for filling the reservoir and in particular, can include a fill port/fill conduit 440. The fill conduit 440 is in fluid communication with the reservoir 430 and is accessible to the user to allow the user to add sanitizing agent to the reservoir 430 when the sanitizing agent is low. As shown in FIG. 4, the sanitizing agent can be fed by gravity to the reservoir 430. As shown in FIG. 4, the fill conduit 440 can be accessible along the top surface 312 of the toilet seat cover 300 and can be sealed by means of a cover or plug 450. The cover 450 can be pivotally opened and has a seal (e.g., a gasket, O-ring, etc.) for sealing the cover 450 to the conduit 440. The conduit 440 and actuator 420 are spaced apart from one another as shown. FIGS. **6*a* and 6*b* show the plug 450 relative to the toilet seat cover 420. FIG. 6*b* shows the plug 450** in the closed, sealed position.

As described herein, the fill port/fill conduit 440 can include a valve member 455 disposed therein. The valve 455 is disposed within the inlet conduit 440 and is constructed such fluid flows in one direction, namely towards the reservoir 430. The valve 455 can thus be a one way valve that only opens when fluid pressure is applied in a direction towards the reservoir 430. The valve 455 can thus include an openable slit 457 that opens to allow fluid flow. When fluid (disinfectant agent) is added to the reservoir 430, the valve 455 opens.

As shown in FIGS. 3 and 4, the mechanism 400 can include a plurality of internal fluid conduits 500 that connect the reservoir 430 to the discharge ports 410. One conduit 500 connects the reservoir 430 to one discharge port 410; however, the system can be configured such that one conduit 500 branches off to more than one port 410. The conduits 500 thus deliver the sanitizing agent to the discharge ports 410.

In a broad sense, when the actuator 420 is activated, fluid is driven from the reservoir 430 through the conduits 500 to the discharge ports 410 where the sanitizing agent is discharged. In the case of the toilet seat cover 300 being in the closed (down) position, the sanitizing agent is discharged and lands on the toilet seat 200. It will be appreciated that each port 410 can produce a small droplet of sanitizing agent and thus, the droplets are arranged in the same pattern as the pattern of the ports 410. In the illustrated embodiment, this results in a generally circular shaped pattern of droplets being formed on the seat 200. The degree to which the actuator 420 is activated and/or the number of times the actuator 420 is activated varies the amount of sanitizing agent that is discharged onto the seat 200. Thus, if additional sanitizing agent is desired, the user simply activates the actuator 420 additional times to cause additional sanitizing agent to be delivered to the ports 410.

The actuator 420 is disposed within an inlet conduit 425 that is formed in the seat cover 300 and forms an entrance into the reservoir 430. The inlet conduit 425 can formed perpendicular to the top surface 312 and to the reservoir 430. Within the inlet conduit 425, there is a valve 600. The valve 600 is disposed within the inlet conduit 425 and is constructed such fluid flows in one direction, namely towards the reservoir 430. The valve 600 can thus be a one way valve that only opens when fluid pressure is applied in a direction towards the reservoir 430. The valve 600 can thus include an openable slit 620 that opens to allow fluid flow.

FIG. 5*b* shows the actuator 420 prior to activation and the valve 600 closed, while FIG. 5*c* shows the actuator 420 activated and the valve 600 in an open position. Any number of different valves can be used so long as they function as one way valves that limit fluid flow within the inlet conduit 425 in a direction towards the reservoir 430. The valve 600 thus prevents fluid (i.e., the sanitizing agent) from flowing backwards from the reservoir 430 towards the actuator 420. Thus, even when the seat cover 300 is in the up position, the sanitizing agent is prevented from flowing into the inlet conduit 425 due to the operation of the valve 600.

In the illustrated embodiment, the mechanism 400 is a compressed air system that used compressed air to cause the sanitizing agent to be discharged through the ports 410 as described herein. More specifically, the mechanism 400 is designed such that operation thereof generates compressed air that is forced into the reservoir 430. When air is delivered into the reservoir 430, the sanitizing agent is displaced from the reservoir 430 based on fluid displacement principles. The compressed air is introduced into a top portion of the reservoir 430 and the conduits 500 are preferably formed along the floor of the reservoir 430 and therefore, the sanitizing agent flows into the conduits 500 to the discharge ports 410 under action of the compressed air. The sanitizing agent that is within the conduits 500 is incrementally advanced as the actuator 420 is operated. As mentioned herein, the fluid (sanitizing agent) does not freely flow out of the ports 410 due to principles of fluid dynamics and surface tension and due to the size of the conduits 500 and the ports 410, as well as the viscosity of the fluid (sanitizing agent). In other words, the small size of the conduits 500 and ports 410 prevents fluid from freely flowing into the conduits from the reservoir unless an appropriate applied force is applied to the fluid in the reservoir. When using compressed air, the injection of the compressed air into the reservoir 430 supplies the necessary force to displace the fluid (sanitizing agent) from the reservoir 430 into the conduits 500 and ultimately out of the discharge outlets 410.

In this embodiment, the actuator 420 is in the form of a depressable bladder structure that is formed of a resilient material that can be compressed and returns naturally to its original form. The actuator 420 can resemble a compressible button. For example, the button 420 can be formed of a rubber or suitable plastic material. The button 420 includes an air inlet (opening) 423 that is formed in a top surface of the actuator 420 and permits fluid to flow both into and out of the hollow actuator 420. The opening 423 thus represents a thumb hole which can be covered by the user's thumb or finger.

The operation of the actuator 420 is as follows. To force compressed air into the reservoir 430, the user places his or her thumb (or finger) over the opening 423 and then presses down on the actuator 420. The air contained within the expanded actuator body is thus driven downward through the inlet conduit causing the valve 600 to open. Once the valve 600 opens, the air flows into the reservoir 430 and displaces an amount of the fluid (sanitizing agent) that is contained within the reservoir 430 as described herein and this results in a small amount (droplet) of sanitizing agent being discharged through ports 410 and when the seat cover 300 is in the closed position, the sanitizing agent flows onto the toilet seat 200. The user then cleans the seat 200 by lifting the cover 300 and using a cleaning implement, such as a towel or the like, to spread the sanitizing agent across the entire surface of the seat 200, thereby cleaning the surface. Any sanitizing agent that may be partially exposed on the bottom surface can be used to clean the bottom surface of the seat cover.

As soon as the user removes his or her thumb from the opening 423, air from atmosphere flows through the opening 423 into the body of the compressible body for inflation thereof since the valve 600 is closed and this results in the compressible body restoring to its original full form. The cycle is complete and the user can repeat the dispensing cycle by pressing the button 420 down to inject more air. Air is continuously injected until the user has discharged the desired amount of sanitizing agent on the seat to permit cleaning thereof (as by wiping the seat).

The mechanism can also include a means for monitoring the level of the sanitizing agent within the reservoir. Any number of different level indicators/gauges can be used. When additional fluid (sanitizing agent) is needed, the user simple lifts the plug 450 and adds fluid to the conduit 440 and the fluid flows into the reservoir.

The arrows shown in the figures show a flow direction of the respective fluid (e.g., air or disinfecting agent depending upon the locations of the arrows).

While the contents of the reservoir are described herein as being a sanitizing agent, this is merely one exemplary fluid and others are equally possible so long as they are cleaning agents including but not limited to disinfecting agents (antibacterial agents).

What is claimed is:

1. A toilet seat assembly having a user operated cleaning feature comprising:

a toilet seat defined by a body having a central opening formed therein, the body including a top surface;

a toilet seat cover that is pivotally attached to the toilet seat and movable between open and closed positions, the toilet seat cover having a bottom surface that faces the toilet seat in the closed position and an opposing top surface; and a cleaning mechanism that is disposed within the toilet seat cover, the mechanism including:

a plurality of discharge ports formed within the toilet seat cover and being open along the bottom surface of the toilet seat cover;

a manually operated actuator that is accessible along one surface of the toilet seat cover;

a reservoir for containing a sanitizing agent, the actuator being operably coupled to the reservoir and operable to drive the sanitizing agent from the reservoir and out of the discharge ports so as to allow sanitizing agent to be delivered to the top surface of the toilet seat when the actuator is operated with the seat cover in the closed position;

wherein the actuator comprises a hollow compressible member that includes an air inlet open to atmosphere, the actuator being disposed within an inlet conduit that opens into the reservoir, wherein the actuator is accessible along the top surface of the toilet seat cover such that a user can directly contact the hollow compressible member and apply a force to cause the compressible member to collapse; and a one way valve that is spaced from the compressible member and is disposed within the inlet conduit below the compressible member and upstream of the reservoir, the one way valve opening in a first direction towards the reservoir to permit air to flow through the inlet conduit into the reservoir.

2. The toilet seat assembly of claim 1, wherein the cleaning mechanism is entirely disposed within the toilet seat cover.

3. The toilet seat assembly of claim 1, wherein the hollow compressible member is formed of rubber.

4. The toilet seat assembly of claim 1, further including a fluid inlet formed in the toilet seat cover and in fluid communication with reservoir for delivering sanitizing agent to the reservoir, the fluid inlet being open along one surface of the toilet seat cover.

5. The toilet seat assembly of claim 4, wherein the fluid inlet is open along the top surface of the toilet seat cover and is sealed closed with a plug.

6. The toilet seat assembly of claim 5, further including a one way valve disposed within the fluid inlet conduit between the plug and the reservoir, the one way opening in a direction towards the reservoir to permit the sanitizing agent to flow through the inlet conduit into the reservoir.

7. The toilet seat assembly of claim 1, wherein the mechanism further includes a plurality of internal conduits that extend radially outward from the reservoir and terminate in the discharge ports.

8. The toilet seat assembly of claim 7, wherein the actuator is located above the reservoir and the internal conduits are located along a bottom of the reservoir when the toilet seat cover is in the closed position.

9. The toilet seat assembly of claim 8, wherein the discharge ports are located below the reservoir.

10. The toilet seat assembly of claim 1, wherein the one way valve opens when the compressible member collapses in the first direction resulting in air within the compressible member being driven into contact with the one way valve thereby causing the one way valve to open.

11. The toilet seat assembly of claim 1, wherein the one way valve is constructed such that it opens when the compressible member is actuated and compressed air is driven into contact with the one way valve causing opening thereof in the first direction resulting in the compressed air flowing into the reservoir, thereby displacing an amount of the sanitizing agent from the reservoir.

12. The toilet seat assembly of claim 1, further including a cover for the actuator, the cover being pivotable between an open position in which the compressible member is accessible and a closed position in which the compressible member is covered and concealed.

13. The toilet seat assembly of claim 1, wherein both the compressible member and the one way valve are fixedly attached to the same side wall that defines the inlet conduit.

14. The toilet seat assembly of claim 13, wherein an air chamber is formed between an underside of the compressible member and a top of the one way valve, the air chamber holding air that is driven upon actuation of the actuator against the one way valve to cause opening thereof to allow the air to flow to the reservoir.

15. A toilet seat assembly having a user operated cleaning feature comprising:

a toilet seat defined by a body having a central opening formed therein, the body including a top surface;

a toilet seat cover that is pivotally attached to the toilet seat and movable between open and closed positions, the toilet seat cover having a bottom surface that faces the toilet seat in the closed position and an opposing top surface; and a manually operated cleaning mechanism that is disposed within the toilet seat cover, the mechanism including:

a plurality of discharge ports formed within the toilet seat cover and being open along the bottom surface of the toilet seat cover, wherein when the toilet seat cover is in the closed position, the discharge ports overlie the toilet seat;

a manually operated actuator that is formed of a compressible member and is accessible along the top surface of the toilet seat cover, the actuator being configured to generate compressed air as a result of a user contacting and applying a force directly against the compressible member to cause collapsing thereof when the toilet seat cover is in the closed position whereby the compressed air is driven from the compressible member, wherein the compressible member includes a through hole that is located along a top of the compressible member such that a user can cover the through hole to capture air within a hollow interior of the compressible member; and a reservoir for containing a sanitizing agent, the actuator being in fluid communication with the reservoir so as to permit compressed air generated by the actuator to be delivered to the reservoir, thereby causing displacement of an amount of the sanitizing agent out of the reservoir, the displaced sanitizing agent flowing to and out of the discharge ports so as to allow sanitizing agent to be delivered to the top surface of the toilet seat when the actuator is operated with the seat cover in the closed position.

* * * * *